US006012549A

United States Patent [19]

Adams

[11] Patent Number: 6,012,549

[45] Date of Patent: Jan. 11, 2000

[54] FIRE ESCAPE LADDER

[76] Inventor: Jimmie Adams, 3719 Wood Lake Rd., Hephzibah, Ga. 30815

[21] Appl. No.: 09/282,938

[22] Filed: Apr. 1, 1999

[51] Int. Cl.[7] ..... E06C 1/56

[52] U.S. Cl. ..... 182/196; 182/206

[58] Field of Search ..... 182/70, 206, 73, 182/74, 196–199

[56] References Cited

U.S. PATENT DOCUMENTS

| | | | |
|---|---|---|---|
| 869,151 | 10/1907 | Zube . | |
| 1,683,138 | 9/1928 | Kautz | 182/199 |
| 3,385,399 | 5/1968 | Burt . | |
| 3,907,064 | 9/1975 | Svalberg | 182/70 |
| 4,164,991 | 8/1979 | Marra | 182/70 |
| 4,243,121 | 1/1981 | Kiss | 182/196 |
| 4,709,783 | 12/1987 | Tomioka | 182/198 |

*Primary Examiner*—Alvin Chin-Shue

[57] ABSTRACT

A fire escape ladder for attaching to a window for providing a means to escape a burning building. The fire escape ladder includes a pair of spaced apart arms adapted for engaging a generally vertically oriented wall such as a window sill. Each of the arms has a generally J-shaped upper portion adapted for hooking onto a sill, a main portion extending at an obtuse angle from the upper portion, and a spacing portion extending from the main portion and adapted for abutting an outer surface of a building. A stabilizer bar extends between the arms. A ladder portion extends from free ends of the main portions of the arms. The ladder portion has a pair of deformable lines and a plurality of rungs coupled to the lines at equally spaced intervals along a length of the lines.

5 Claims, 2 Drawing Sheets

FIRE ESCAPE LADDER

BACKGROUND OF THE INVENTION

1. Field of the Invention

The present invention relates to fire escape devices and more particularly pertains to a new fire escape ladder for attaching to a window for providing a means to escape a burning building.

2. Description of the Prior Art

The use of fire escape devices is known in the prior art. More specifically, fire escape devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 800,934; U.S. Pat. No. 869,151; U.S. Pat. No. 3,894,613; U.S. Pat. No. 3,307,654; U.S. Pat. No. 3,042,143; and U.S. Pat. No. Des. 370,736.

While these devices fulfill their respective, particular objectives and requirements, the aforementioned patents do not disclose a new fire escape ladder. The inventive device includes a pair of spaced apart arms adapted for engaging a generally vertically oriented wall such as a window sill. Each of the arms has a generally J-shaped upper portion adapted for hooking onto a sill, a main portion extending at an obtuse angle from the upper portion, and a spacing portion extending from the main portion and is adapted for abutting an outer surface of a building. A stabilizer bar extends between the arms. A ladder portion extends from free ends of the main portions of the arms, the ladder portion has a pair of deformable lines and a plurality of rungs coupled to the lines at equally spaced intervals along a length of the lines.

In these respects, the fire escape ladder according to the present invention substantially departs from the conventional concepts and designs of the prior art, and in so doing provides an apparatus primarily developed for the purpose of attaching to a window for providing a means to escape a burning building.

SUMMARY OF THE INVENTION

In view of the foregoing disadvantages inherent in the known types of fire escape devices now present in the prior art, the present invention provides a new fire escape ladder construction wherein the same can be utilized for attaching to a window for providing a means to escape a burning building.

The general purpose of the present invention, which will be described subsequently in greater detail, is to provide a new fire escape ladder apparatus and method which has many of the advantages of the fire escape devices mentioned heretofore and many novel features that result in a new fire escape ladder which is not anticipated, rendered obvious, suggested, or even implied by any of the prior art fire escape devices, either alone or in any combination thereof.

To attain this, the present invention generally comprises a pair of spaced apart arms adapted for engaging a generally vertically oriented wall such as a window sill. Each of the arms has a generally J-shaped upper portion adapted for hooking onto a sill, a main portion extending at an obtuse angle from the upper portion, and a spacing portion extending from the main portion and is adapted for abutting an outer surface of a building. A stabilizer bar extends between the arms. A ladder portion extends from free ends of the main portions of the arms, the ladder portion has a pair of deformable lines and a plurality of rungs coupled to the lines at equally spaced intervals along a length of the lines.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new fire escape ladder apparatus and method which has many of the advantages of the fire escape devices mentioned heretofore and many novel features that result in a new fire escape ladder which is not anticipated, rendered obvious, suggested, or even implied by any of the prior art fire escape devices, either alone or in any combination thereof It is another object of the present invention to provide a new fire escape ladder which may be easily and efficiently manufactured and marketed.

It is a further object of the present invention to provide a new fire escape ladder which is of a durable and reliable construction.

An even further object of the present invention is to provide a new fire escape ladder which is susceptible of a low cost of manufacture with regard to both materials and labor, and which accordingly is then susceptible of low prices of sale to the consuming public, thereby making such fire escape ladder economically available to the buying public.

Still yet another object of the present invention is to provide a new fire escape ladder which provides in the apparatuses and methods of the prior art some of the advantages thereof, while simultaneously overcoming some of the disadvantages normally associated therewith.

Still another object of the present invention is to provide a new fire escape ladder for attaching to a window for providing a means to escape a burning building.

Yet another object of the present invention is to provide a new fire escape ladder which includes a pair of spaced apart arms adapted for engaging a generally vertically oriented wall such as a window sill. Each of the arms has a generally J-shaped upper portion adapted for hooking onto a sill, a main portion extending at an obtuse angle from the upper portion, and a spacing portion extending from the main portion and is adapted for abutting an outer surface of a building. A stabilizer bar extends between the arms. A ladder portion extends from free ends of the main portions of the arms, the ladder portion has a pair of deformable lines and a plurality of rungs coupled to the lines at equally spaced intervals along a length of the lines.

Still yet another object of the present invention is to provide a new fire escape ladder that has retainer pins to hold the ladder portion in a rolled up configuration until it needs to be deployed. This prevents the problem of premature unrolling of the ladder common to other such devices.

Even still another object of the present invention is to provide a new fire escape ladder that saves lives.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
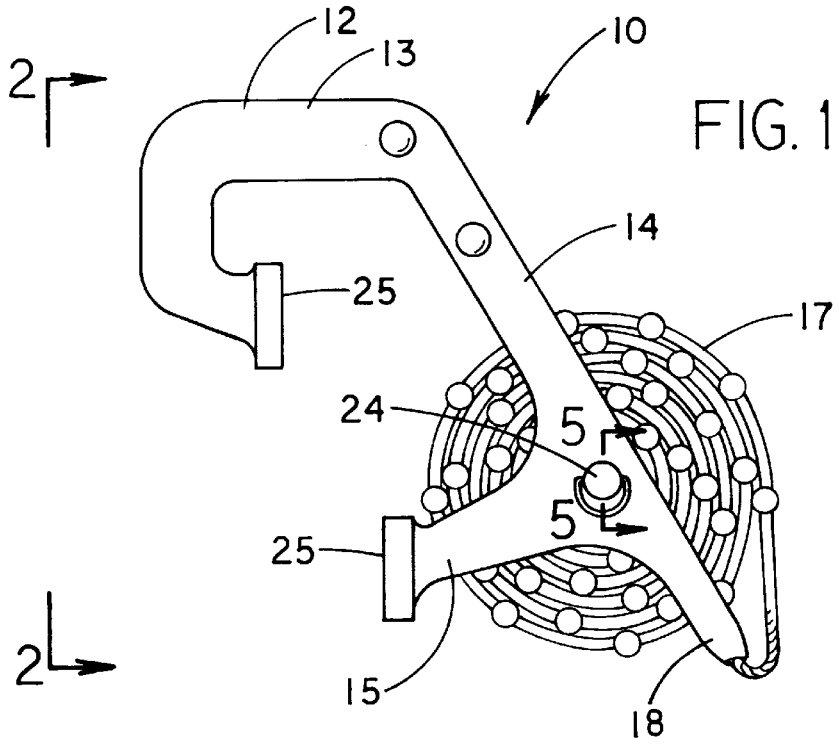
FIG. 1 is a schematic side view of a new fire escape ladder according to the present invention.

With reference now to the drawings, and in particular to FIGS. 1 through 5 thereof, a new fire escape ladder embodying the principles and concepts of the present invention and generally designated by the reference numeral 10 will be described.

As best illustrated in FIGS. 1 through 5, the fire escape ladder 10 generally comprises a pair of spaced apart arms 12 adapted for engaging a generally vertically oriented wall 1 such as a window sill. Each of the arms has a generally J-shaped upper portion 13 adapted for hooking onto a sill, a main portion 14 extending at an obtuse angle from the upper portion, and a spacing portion 15 extending from the main portion and adapted for abutting an outer surface of a building. One or two stabilizer bars 16 extend between the arms. A ladder portion 17 extends from free ends 18 of the main portions of the arms. The ladder portion has a pair of deformable lines 19 and a plurality of rungs 20 coupled to the lines at equally spaced intervals along a length of the lines. The lines can be of rope, as shown in the Figures, as well as other material such as chains.

Preferably, the ladder portion has a bottom rung 21 coupled to free ends of the lines. Ideally, the bottom rung is weighted. This helps the ladder portion unroll more quickly, as well as helps keep the ladder portion straight against a wall of the building in windy conditions. The weight of the bottom rung should be at least one pound to sufficiently hold the ladder portion from swaying.

Figure 2:
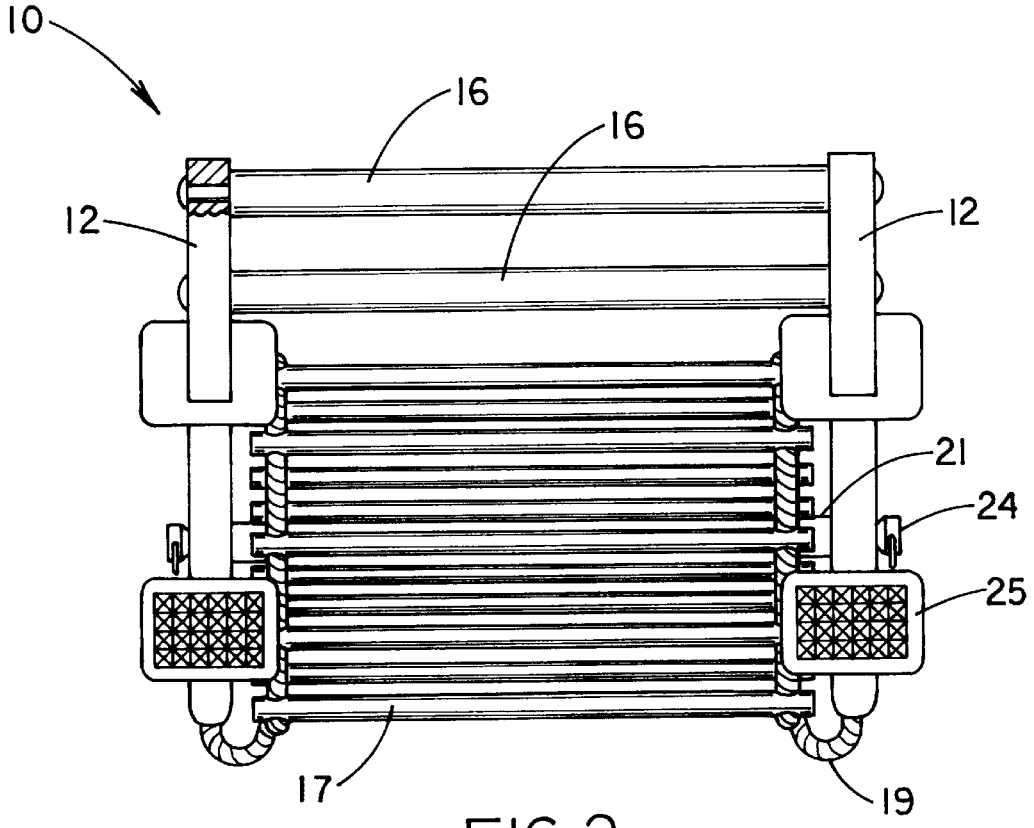
FIG. 2 is a schematic side view of the present invention.
Figure 4:
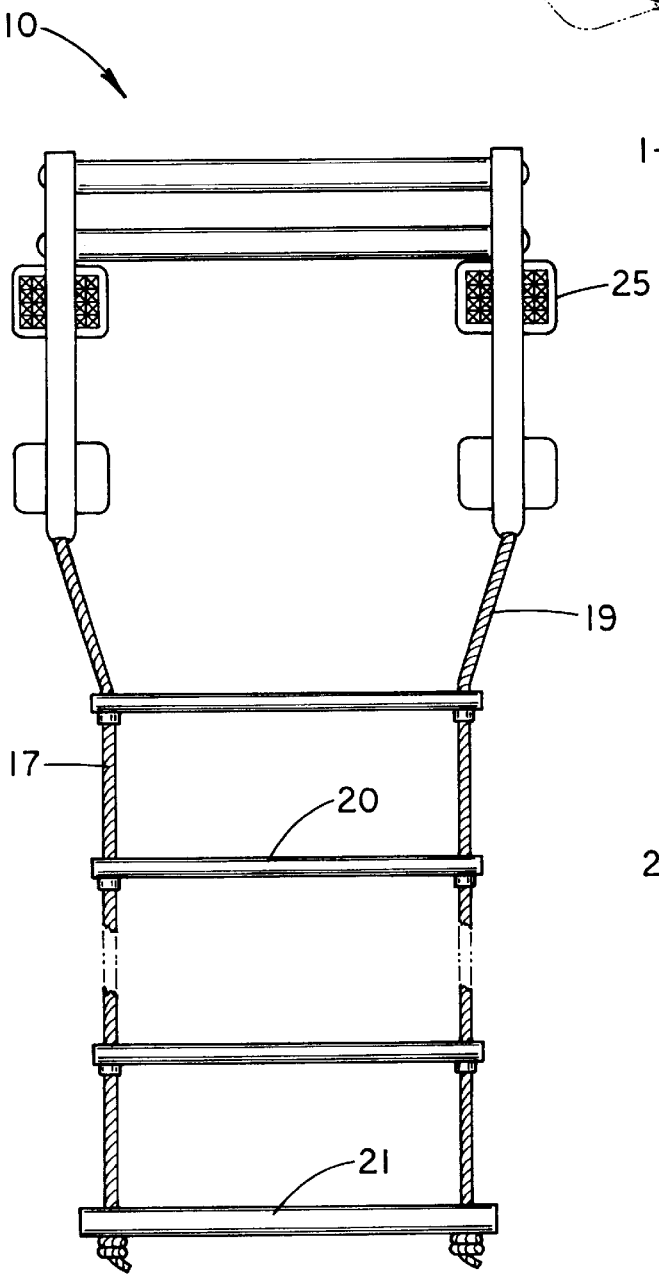
FIG. 4 is a schematic side view of the present invention in a deployed position.
Figure 5:
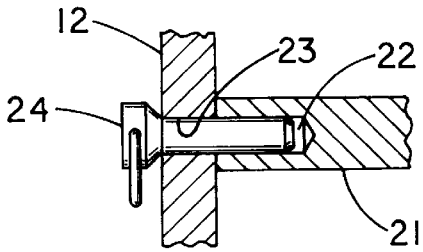
FIG. 5 is a schematic cross sectional view of the present invention.

The ladder portion is positionable in a retracted orientation, shown in FIGS. 1 and 2, and a deployed orientation, shown in FIG. 4. The rungs and lines are rolled up around the bottom rung when the ladder portion is in the retracted orientation. The rungs and lines is unrolled when the ladder portion is in the deployed orientation.

Figure 3:
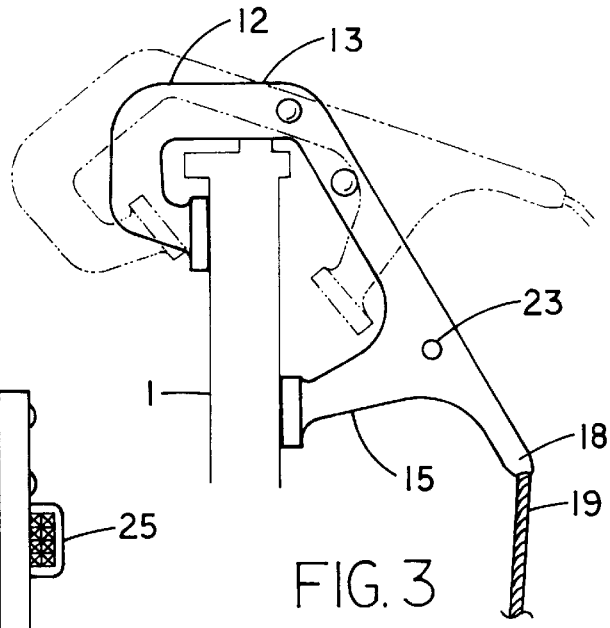
FIG. 3 is a schematic partial side view of the present invention.

Preferably, the bottom rung has a pair of cavities 22 extending into opposite ends thereof. Each of the arm portions has an aperture 23 through it. A pair of retainer pins 24 are insertable through the apertures of the arms and into the cavities of the bottom rung for pinning the bottom rung to the arms. See FIG. 5. This is required to keep the ladder portion in the retracted orientation until it is ready to be deployed. Ideally, the apertures of the arms are positioned as shown in FIG. 3 so that the arms can be hung on a sill as shown in FIG. 1 before the pins are removed and the ladder portion deployed.

Each of the lines and the rungs should be fire resistant and should resist absorption and conduction of heat so that a user will not get burned by the ladder portion if the device has been exposed to heat.

Preferably, each of the spacing portions of the arms extends substantially perpendicular from the associated arm for helping support the weight of a user climbing down the ladder portion. This configuration helps reduce some of the stress exerted on the window sill by the upper portions of the arms, particularly important where multiple users are hurriedly climbing down the ladder portion simultaneously.

Also preferably, free ends of the upper portions and spacing portions of the arms each have a pad portion 25 adapted for frictionally engaging a surface to prevent sliding of the upper portions along the surface. The pad portions may be resiliently deformable, such as a rubber pad, or may have a corrugated surface that bites into the surface, for example.

Ideally, each of the free ends of the main portions of the arms has a recess formed therein so that the associated line of the ladder portion hangs straight down in the manner shown in FIG. 3.

The preferred length of each of the rungs between its ends is between about 10 and 24 inches, ideally about 16 inches. Exemplary lengths of the lines of the ladder portion are 15, 25, and 50 feet.

In use, the arms are hung on a sill as shown in FIG. 3. The retaining pins are removed and the ladder portion is deployed. A user climbs down the ladder to escape a burning building.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. An escape device, comprising:

a pair of spaced apart arms adapted for engaging a generally vertically oriented wall;

each of said arms having a generally J-shaped upper portion adapted for hooking onto a sill, a main portion extending at an obtuse angle from said upper portion, and a spacing portion extending from said main portion and being adapted for abutting an outer surface of a building;

a stabilizer bar extending between said arms; and a ladder portion extending from free ends of said main portions of said arms, said ladder portion having a pair of deformable lines and a plurality of rungs coupled to said lines at equally spaced intervals along a length of said lines wherein said ladder portion has a bottom rung and positionable in a retractable orientation and a deployed orientation, said bottom rung having cavities extending into opposite ends thereof, each of said arms having an aperture therethrough, a pair of retainer pins being insertable therethrough said apertures of said arms and into said cavities of said bottom rung for pinning said bottom rung to said arms.

2. The escape device of claim 1, wherein said bottom rung being coupled to free ends of said lines, said bottom rung being weighted.

3. The escape device of claim 1, wherein free ends of said upper portions and spacing portions of the arms each have a pad portion adapted for frictionally engaging a surface.

4. The escape device of claim 1, wherein each of said free ends of said main portions of said arms have a recess formed therein.

5. An escape device, comprising:

a pair of spaced apart arms adapted for engaging a generally vertically oriented wall;

each of the arms having a generally J-shaped upper portion adapted for hooking onto a sill, a main portion extending at an obtuse angle from said upper portion, and a spacing portion extending from said main portion and being adapted for abutting an outer surface of a building;

first and second stabilizer bars extending between said arms;

a ladder portion extending from free ends of said main portions of said arms, said ladder portion having a pair of deformable lines and a plurality of rungs coupled to said lines at equally spaced intervals along a length of said lines;

said ladder portion having a bottom rung being coupled to free ends of said lines;

said bottom rung being weighted;

said ladder portion being positionable in a retracted orientation and a deployed orientation, said rungs and lines being rolled up around said bottom rung when said ladder portion is in said retracted orientation, said rungs and lines being unrolled when said ladder portion is in said deployed orientation;

said bottom rung having cavities extending into opposite ends thereof, each of said arms having an aperture therethrough, a pair of retainer pins being insertable through said apertures of said arms and into said cavities of said bottom rung for pinning said bottom rung to said arms;

free ends of the upper portions and spacing portions of the arms each having a pad portion adapted for frictionally engaging a surface; and each of said free ends of said main portions of said arms having a recess formed therein.

* * * * *